US010834995B2

(12) United States Patent
Fox

(10) Patent No.: US 10,834,995 B2
(45) Date of Patent: Nov. 17, 2020

(54) FOOT COVERING WITH DIVIDED SOLE

(71) Applicant: Pointe Noir Pty Ltd., St. Helier (JE)

(72) Inventor: David Fox, St Helier (JE)

(73) Assignee: Pointe Noir Pty Ltd., St, Helier (JE)

( * ) Notice: Subject to any disclaimer, the term of this patent is extended or adjusted under 35 U.S.C. 154(b) by 0 days.

(21) Appl. No.: 16/270,157

(22) Filed: Feb. 7, 2019

(65) Prior Publication Data

US 2020/0253323 A1 Aug. 13, 2020

(51) Int. Cl.

| | |
|---|---|
| ***A43B 5/12*** | (2006.01) |
| ***A43B 1/00*** | (2006.01) |
| ***A43B 3/10*** | (2006.01) |
| ***A43B 23/02*** | (2006.01) |
| ***A43B 13/16*** | (2006.01) |
| ***A43B 7/14*** | (2006.01) |
| ***A43B 3/00*** | (2006.01) |

(52) U.S. Cl.

CPC ..... *A43B 5/12* (2013.01); *A43B 1/0018* (2013.01); *A43B 3/0031* (2013.01); *A43B 3/108* (2013.01); *A43B 7/141* (2013.01); *A43B 13/16* (2013.01); *A43B 23/028* (2013.01)

(58) Field of Classification Search

CPC ..... A43B 5/12; A43B 13/16; A43B 13/141

See application file for complete search history.

(56) References Cited

U.S. PATENT DOCUMENTS

| | | | |
|---|---|---|---|
| 2,252,315 | A | 8/1941 | Doree |
| 2,352,532 | A | 6/1944 | Ghez et al. |
| 3,963,251 | A | 6/1976 | Miano |
| 4,232,457 | A | 11/1980 | Mosher |
| 4,271,610 | A | 6/1981 | Parrent |
| 4,309,832 | A | 1/1982 | Hunt |

(Continued)

FOREIGN PATENT DOCUMENTS

| | | |
|---|---|---|
| EP | 2605675 | 6/2013 |
| GB | 2156652 | 10/1985 |

(Continued)

OTHER PUBLICATIONS

International Search Report and Written Opinion for PCT Application No. PCT/AU2020/050025, dated Mar. 13, 2020, 9 pages.

*Primary Examiner* — Ted Kavanaugh

(74) *Attorney, Agent, or Firm* — Ganz Pollard, LLC

(57) ABSTRACT

In one possible embodiment, the inventive subject matter is directed to a foot covering, comprising: a thin, flexible compartment for receiving a foot. The compartment has a forefoot section, a midfoot section, and a rearfoot section of selected rigidity. The compartment has a top surface for securing the foot and a ground-facing surface having a sole divided into at least two portions comprising (1) a forefoot portion and midfoot portion and/or (2) a midfoot portion and a rearfoot portion. At least one sole portion comprises a midfoot portion disposed between a forefoot portion and/or a rearfoot portion. In the foot covering, each pair of sole portions is divided along a flexural line running generally transverse to the longitudinal axis of the foot. The sole portions and flexural line(s), in combination with the flexible compartment, have a material construction and are arranged so as to facilitate the close conforming of the foot covering to the foot of an intended user through plantar flexion to dorsiflexion.

17 Claims, 5 Drawing Sheets

(56) References Cited

U.S. PATENT DOCUMENTS

| | | | | |
|---|---|---|---|---|
| 4,519,148 | A * | 5/1985 | Sisco | A43B 5/12 36/103 |
| 4,554,749 | A * | 11/1985 | Ostrander | A43B 3/108 36/102 |
| 4,944,099 | A | 7/1990 | Davis | |
| 5,035,069 | A | 7/1991 | Minden | |
| 5,384,973 | A | 1/1995 | Lyden | |
| 5,682,685 | A | 11/1997 | Terlizzi | |
| 5,806,209 | A | 9/1998 | Crowley et al. | |
| 5,915,820 | A | 6/1999 | Kraeuter | |
| 5,956,868 | A | 9/1999 | Stevens et al. | |
| 6,076,284 | A | 6/2000 | Terlizzi | |
| 6,151,800 | A | 11/2000 | Kerr et al. | |
| 6,272,772 | B1 | 8/2001 | Sherman | |
| 6,588,124 | B2 | 7/2003 | Morrone | |
| 6,634,121 | B2 * | 10/2003 | Sordi | A43B 13/141 36/102 |
| 6,745,498 | B2 | 6/2004 | LaDuca | |
| 6,895,693 | B2 | 5/2005 | Baruck | |
| 7,051,458 | B2 | 5/2006 | LaDuca | |
| D640,861 | S | 7/2011 | Wilkenfeld | |
| D716,026 | S | 10/2014 | Hazzouri | |
| 2002/0078591 | A1 * | 6/2002 | Morrone | A43B 13/16 36/8.3 |
| 2003/0121176 | A1 | 7/2003 | Baruck | |
| 2003/0145495 | A1 | 8/2003 | Green | |
| 2007/0199208 | A1 | 8/2007 | Wilkenfeld | |
| 2008/0034613 | A1 | 2/2008 | Wilkenfeld et al. | |
| 2008/0086906 | A1 | 4/2008 | Wilkenfeld | |
| 2008/0086912 | A1 * | 4/2008 | Wilkenfeld | A43B 5/12 36/92 |
| 2010/0126042 | A1 | 5/2010 | Wyon | |
| 2013/0104420 | A1 | 5/2013 | Heathcote | |
| 2014/0033567 | A1 | 2/2014 | Heathcote | |
| 2014/0352170 | A1 | 12/2014 | Heathcote | |
| 2015/0342293 | A1 | 12/2015 | Hazzouri | |
| 2016/0278471 | A1 * | 9/2016 | Rossignoli | A43B 13/141 |
| 2017/0127757 | A1 | 5/2017 | Rushbrook et al. | |

FOREIGN PATENT DOCUMENTS

| | | |
|---|---|---|
| GB | 2288966 | 11/1995 |
| WO | 02051274 | 7/2002 |
| WO | 2011116423 | 9/2011 |
| WO | 2012021919 | 2/2012 |

* cited by examiner

FOOT COVERING WITH DIVIDED SOLE

BACKGROUND

The inventive subject matter disclosed herein relates to light-weight, flexible foot coverings in general, and more particularly to dance shoes, such as ballet flats.

Ballet and modern dance can include periods of posing, running, jumping, spinning, leaping, and physical interactions among individuals. An ever-present need exists for improved footwear that facilitates graceful and inspiring movements, such as rotating on the tips of the toes or walking and landing on the toes, even if these movements are not natural movements for the average person.

However, traditional dance shoes or ballet slippers or flats may not feel comfortable or provide sufficient protection, especially when pivoting and the dancer balances on the metatarsal head area of the foot. Where adequate protection is provided in lightweight, flexible dance footwear, such as ballet flats, such protection compromises the performance and aesthetics of such shoes due to their stiff and inflexible nature: Furthermore, shoes that do not conform closely to foot may slip against the foot during foot movements, compromising performance, and they do not provide the elegant aesthetic of a natural foot, which is prized in ballet and other dance forms.

SUMMARY

The inventive subject matter offers a solution for these problems by providing a foot covering that is lightweight flexible, supportive of foot anatomy, and closely conforming to the foot through a range of foot positions and dance movements. The inventive subject matter provides these functional advantages while closely, aesthetically conforming to the user's foot. These and other advantages will become more apparent from the detailed disclosure that follows.

In one possible embodiment, the inventive subject matter is directed to a foot covering, comprising: a thin, flexible compartment for receiving a foot. The compartment has a forefoot section, a midfoot section, and a rearfoot section of selected rigidity. The compartment has a top surface for securing the foot and a ground-facing surface having a sole divided into at least two portions comprising (1) a forefoot portion and midfoot portion and/or (2) a midfoot portion and a rearfoot portion. At least one sole portion comprises a midfoot portion disposed between a forefoot portion and/or a rearfoot portion. In the foot covering, each pair of sole portions is divided along a flexural line running generally transverse to the longitudinal axis of the foot. The sole portions and flexural line(s), in combination with the flexible compartment, have a material construction and are arranged to facilitate the close conforming of the foot covering to the foot of an intended user through plantar flexion to dorsiflexion.

In any embodiment contemplated herein, the sole may be divided between (1) forefoot and midfoot portions; (2) rearfoot and midfoot section; and/or (3) midfoot and forefoot sections and midfoot and rearfoot sections.

In any embodiment contemplated herein, the forefoot sole portion may have a shape that is wider than it is long; corresponding approximately to the width of a foot and covering approximately the first to the fifth metatarsal heads.

In any embodiment contemplated herein, the ground-facing surface may include and/or be mainly free of stiffening material at the forefoot section, rearfoot section, and/or mid-section of the covering.

In any embodiment contemplated herein, the forefoot outsole portion may have a proximal edge extending to just proximal at least four of the five metatarsal heads, at least one metatarsal head being the first metatarsal, and has a distal edge that extends to about the metatarsal-phalangal joints.

In any embodiment contemplated herein, the forefoot sole portion may have a substantially kidney-like shape.

In any embodiment contemplated herein, the heel sole portion may have a substantially kidney-like shape.

In any embodiment contemplated herein, the compartment may have a ground-facing surface provided with flat pleats around at least the forefoot section.

In any embodiment contemplated herein, the compartment may be formed of a substantially single ply material.

In any embodiment contemplated herein, the compartment may be an elastic material of one or more plies.

In any embodiment contemplated herein, the compartment may include a binding and/or over-the-arch strap system to hold the compartment on a foot.

In any embodiment contemplated herein, the compartment may be formed on a last having a base surface with a length to width ratio of about 3/1.

In another possible embodiment, the inventive subject matter is directed to a method of making a foot covering that includes the steps of: providing a thin, flexible compartment for receiving a foot, the compartment having a forefoot section, a mid-section, and a heel section, with the compartment having a top surface for securing the foot; providing a ground-facing sole portion divided into at least two portions comprising at least a midfoot portion and divided therefrom (1) a paired forefoot portion and/or (2) a paired rearfoot portion, and wherein each pair of sole portions is divided along a flexural line running generally transverse to the longitudinal axis of the foot; assembling the sole to the foot compartment; and wherein the sole portion and flexural line(s), in combination with the flexible compartment, have a material construction and are arranged so as to facilitate a close conforming of the foot covering to the foot of an intended user through plantar flexion to dorsiflexion foot movements, and wherein the covering is constructed as a ballet slipper of lightweight and flexible materials.

In any embodiment contemplated herein, the covering may include a rigidifier that is disposed over at least over a midfoot section of the covering, the rigidifier configured in the covering so as to cause resistance against the arch of the foot and help the covering mirror the arch of the foot for better fit against the arch in plantar flexions. In any embodiment contemplated herein, the rigidifier may be removably disposed in a pocket formed in the covering. In any embodiment contemplated herein, the pocket may be disposed between the midfoot sole portion and the foot compartment. In any embodiment contemplated herein, the rigidifier may extends into a forefoot section of the foot covering, a rearfoot section, or both the forefoot and rearfoot sections. In any embodiment contemplated herein, the rigidifier may varying width along its length and thereby a corresponding varying rigidity along its length. In any embodiment contemplated herein, one or more additional rigidifiers may be configured for the pocket, each rigidifier varying in rigidity from another rigidifier.

Other embodiments are contemplated in the detailed description below and in the appended Figures, and in the claims, as originally written or amended, the claims as such being incorporated by reference into this Summary.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show various embodiments of inventive subject matter (except where prior art is noted).

DETAILED DESCRIPTION

Figure 1:
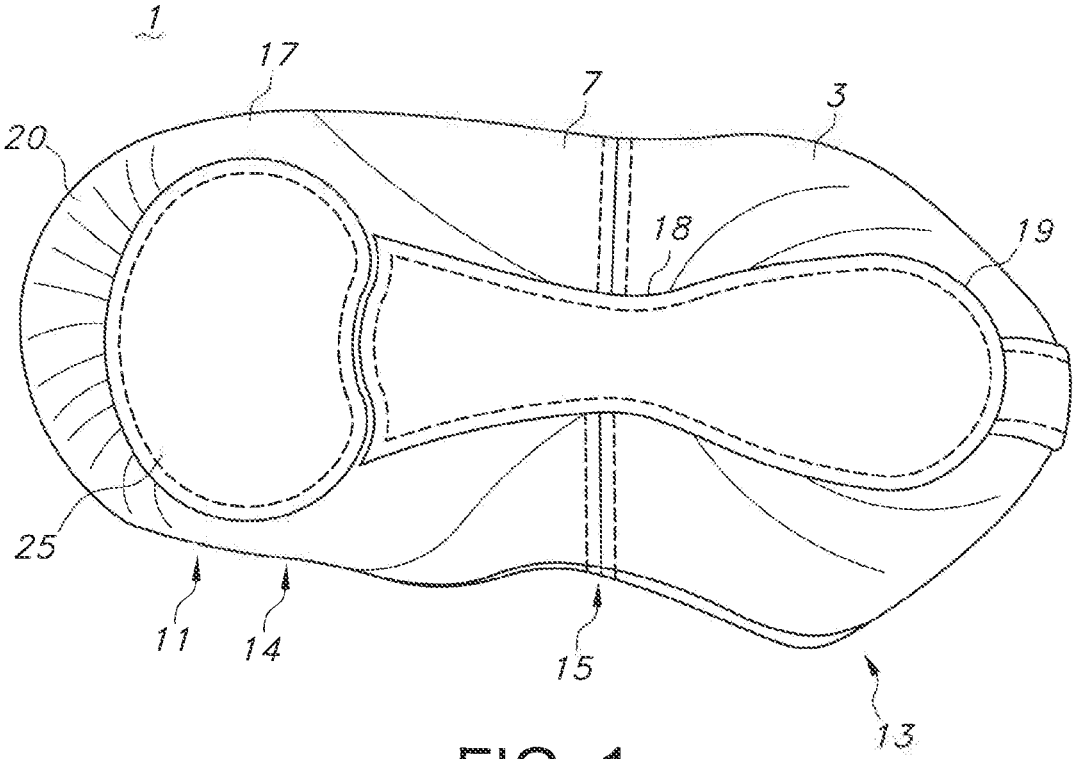
FIG. 1 shows a bottom view of a foot covering with a sole divided between forefoot and midfoot sections.
Figure 2:
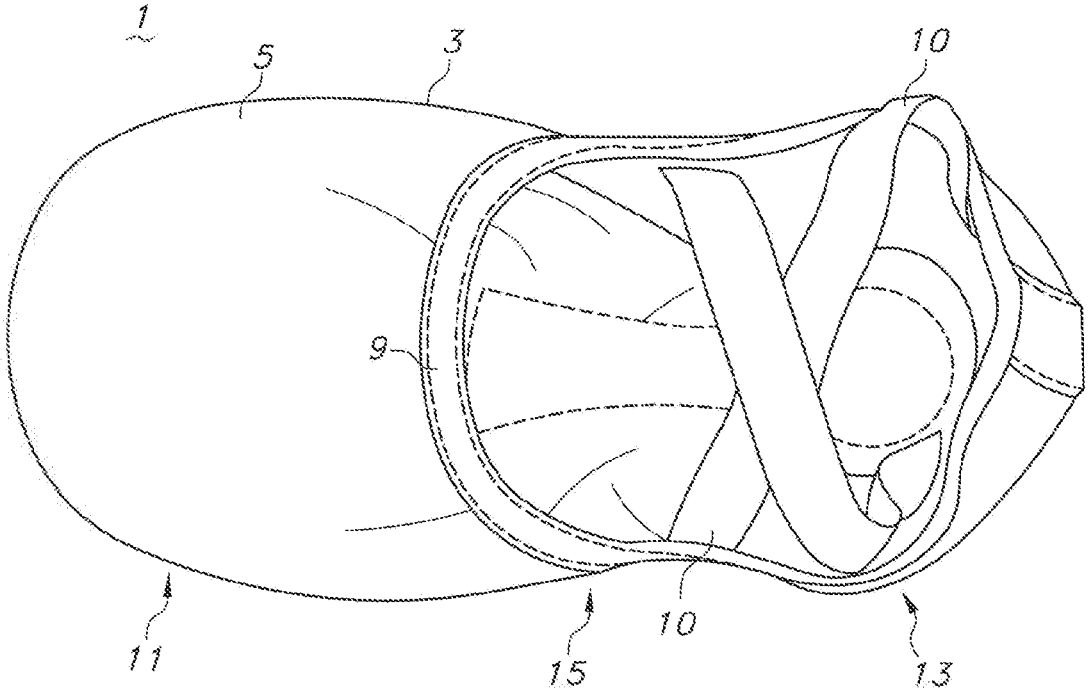
FIG. 2 shows a top view of the foot covering of FIG. 1.
Figure 3:
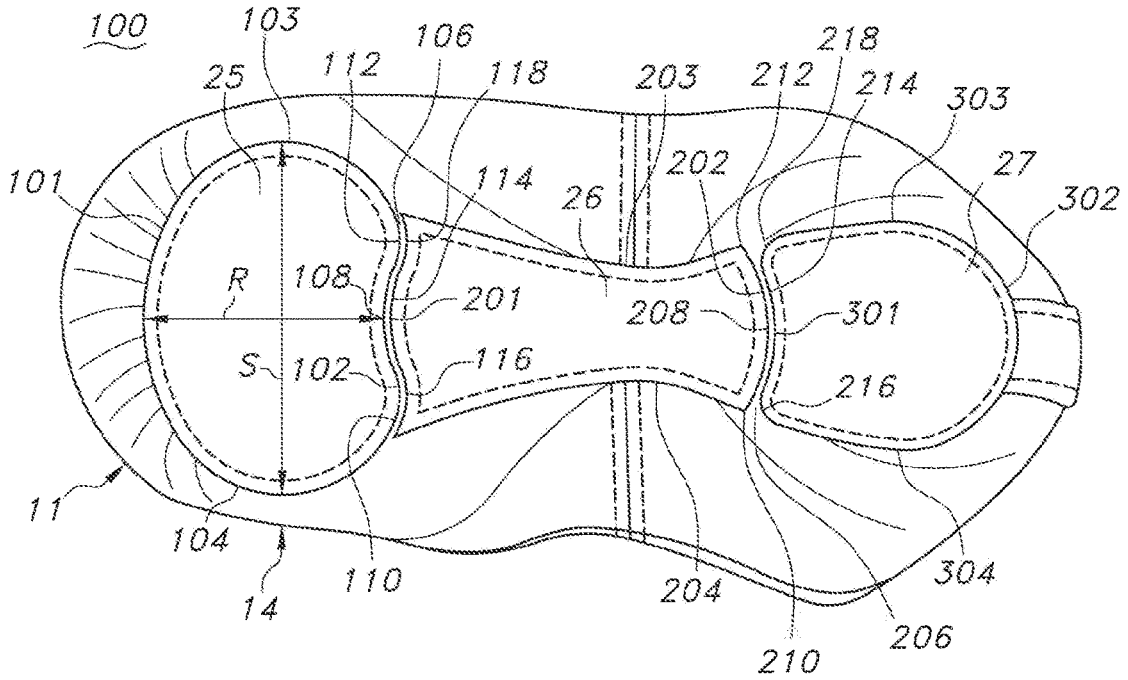
FIG. 3 shows a bottom view of an alternative embodiment of a foot covering with a sole divided between (1) forefoot and midfoot sections and (2) midfoot and rearfoot sections.

Representative embodiments of the inventive subject matter are shown in FIGS. 1-8C, wherein the same or similar features share common reference numerals.

An overview of foot anatomy will help illustrate the invention, and facilitate a better understanding of it. The forefoot is composed of five toes and their connecting long bones, the metatarsals. Each toe, or phalanx, is made up of small bones, the phalanges. The big toe, or hallux has two phalanges, two joints, the interphalangeal joints; and two tiny, round sesamoid bones that enable it to move up and down. The other four toes each have three bones and two joints. The second row of phalanges is connected to the metatarsal heads by five metatarsal phalangeal joints at the ball of the foot, i.e., where the foot is normally at its widest.

The midfoot has five irregularly shaped tarsal bones, which form the foot's arch. The rearfoot is composed of three joints and links the midfoot to the ankle (talus). The top of the talus is connected to the two long bones of the lower leg (tibia and fibula), forming a hinge that allows the foot to move up and down. The heel bone (calcaneus) is the largest bone in the foot. It joins the talus to form the subtalar joint, which enables the foot to rotate at the ankle.

In general, a foot covering or dance shoe includes a compartment for receiving a foot. Hereinafter, the terms "dance shoe" and "foot covering" are used interchangeably. Here, a foot covering in the nature of a dance shoe 1, (100, 200) is shown with a compartment 3 having a top surface 5, for securing the foot, and a ground-facing surface 7. The compartment 3 is usually formed of a thin and flexible material, such as a fabric that is adapted to cover a foot. For example, the compartment may be formed of a lightweight, stretchable mesh material, such as cotton, canvas, leather, or synthetics. The top surface may also be in the form of straps or bands of material.

Compartment 3 includes a forefoot section, which includes toe section 11 and ball section 14; a heel or rearfoot section 13; and a mid-section 15. The ground-facing surface 7 of compartment 3 includes a first, forefoot sole region 17, a second, midfoot sole region 18, and a third, rearfoot sole region 19. The ground-facing surface 7 of the dance shoe 1 usually has one or more protective pads or outsole portions designed to better protect the foot. These protective outsole portions are incorporated into the sole of the dance shoe as a divided sole structure, namely one or more adjacent sole regions that are physically or at least functionally separated, as described in more detail below. The forefoot sole portion can be separated from the midfoot sole portion and/or the midfoot sole portion is separated from the rearfoot sole portion. As used herein, an outsole portion refers to a relatively thin but pliable layer of material and excludes relatively thick molded soles of rubber, EVA or PU. The shoes disclosed herein would also generally be free of midsoles that serve to provide substantial energy dissipation to ground forces like those in athletic shoes, e.g., EVA and PU foamed materials that are molded into relatively thick midsoles. However, the shoes may include thin, foamed insoles, which provide a comfort effect and no substantial energy dissipation effect relatively to midsoles in running and other athletic shoes.

In prior art ballet slippers and flats, the midfoot section may be devoid of any outsole material, leaving the forefoot and rearfoot sections separated from one another. While this arrangement may enhance the flexibility of the foot covering, it leaves the midfoot section unsupported and protected. Other prior art designs have full-length outsoles, which compromise flexibility and do not conform closely to the foot. Accordingly, one of the principle advantages of the inventive subject matter is providing a midfoot outsole portion that is divided from the forefoot and/or rearfoot outsole portions, unifying performance, protection, support and close conformance in a single item of footwear.

FIGS. 1-8 illustrate a dance shoe according to an example embodiment wherein a divided sole ballet slipper is configured with selectively placed soles that maximize the area of the foot covered but have one or more flex lines that are free of sole or substantially free of sole, allowing a natural flexation of the foot through a range of positions, including from a pointe, plantar flexion position, a standing position, and a dorsiflexion position.

The forefoot outsole portion 25 is disposed entirely or mainly in the forefoot section 45 of the foot. In the embodiment shown, the shape of the forefoot outsole portion 25 covers approximately the width of a foot from about at least the first four metatarsal heads to about the rears of those metatarsals and has a substantially kidney-like shape. The forefoot outsole portion 25 underlies approximately the forefoot section 45 of the foot, corresponding to the toe section 11 and the ball section 14 of the dance shoe.

The forefoot outsole portion 25 sits over the ground-facing surface of compartment 3. It may cover at least four metatarsal heads when the person wearing the foot covering is in demi-position and provide traction when the person wearing the foot covering stands on a flat surface. The length of the forefoot outsole portion extends from just proximal (at about line F, FIG. 4, the metatarsal heads to about the second proximal row of phalanges (at about line E, FIG. 4). The forefoot outsole 25 is positioned relative to the foot so that the outsole protects the widest part of the foot, which is associated with the metatarsal heads on which weight-bearing dance moves and other moves may occur. Looking at FIG. 3, the forefoot outsole portion 25 has a distal edge 101 and a proximal edge 102. It has left (lateral) edge 103 and right (medial) edge 104. Additionally, the exact geometric shape of the protective outsoles may also vary in response to several factors such as the size of the foot. In keeping with the principle of some embodiments, the forefoot outsole portion may be wider than it is long (S>R) and will be disposed so as to have a proximal edge extending to about line F in FIG. 4 and distal edge extending to about line E in FIG. 4, so as to cover at least four of the five metatarsal heads.

As can be seen, the forefoot outsole portion 25 is disposed mainly in the forefoot section 14 of compartment 3, although there is a small portion extending proximally into the mid-section 15.

In midsection 15 of the foot covering, a midfoot outsole portion 26 sits over the ground-facing surface of compartment 3 and is spaced from but closely adjacent proximal edge 102 of the forefoot portion 25. The midfoot outsole portion has a distal edge 201 and a proximal edge 202. It has left (lateral) edge 203 and right (medial) edge 204. The midfoot outsole portion may have a distal edge 201 configured to have a generally complementary shape to the shape of the proximal edge 102 of the forefoot section.

In certain embodiments, the forefoot and/or mid-section and other sections of the dance shoe lack stiffening material, such as shanks or rigidifying plates. In some embodiments, a high degree of flexibility is desirable in the shoe, with selective flexural lines at dividers 106 and/or 206.

Figure 8C:
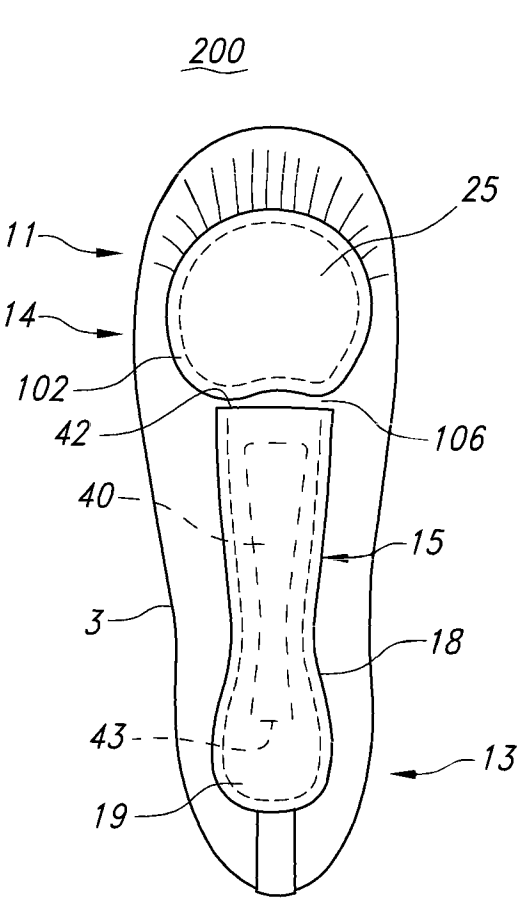
FIG. 8C shows the embodiment of FIG. 8B with the removable rigidifier fully inserted into the pocket.
Figure 8B:
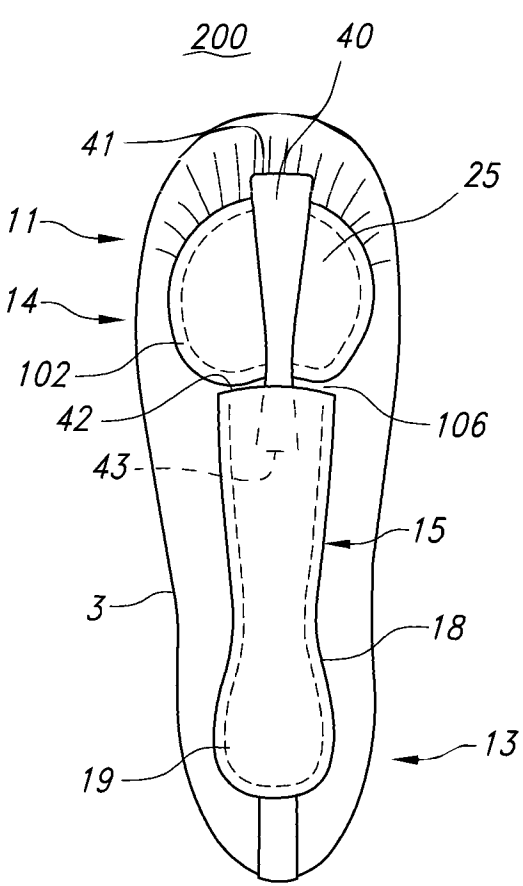
FIG. 8B shows the embodiment of FIG. 8A with a removable rigidifier partially exposed from a pocket for holding the rigidifier.
Figure 8A:
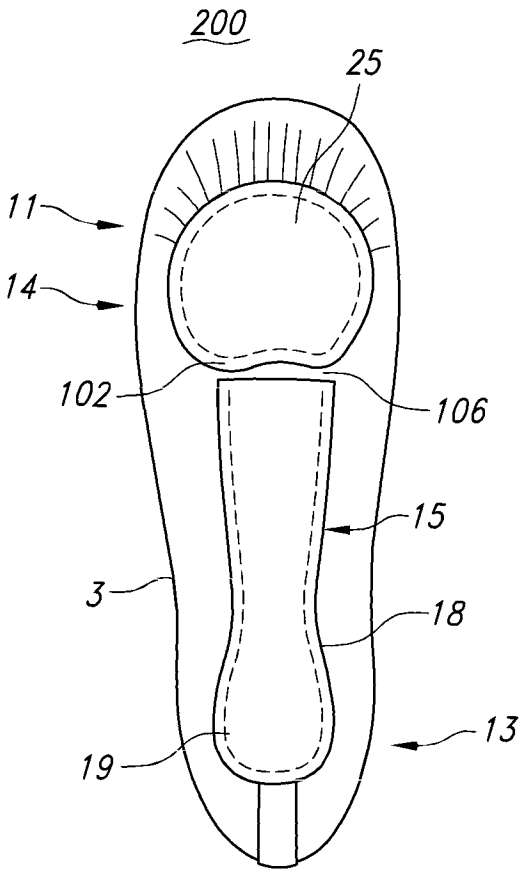
FIG. 8A shows an alternative embodiment with rigidified midfoot section.

In other embodiments, the sole can be rigidified with a rigidifier to cause resistance against the arch of the foot and help the shoe mirror the arch of the foot for better fit against the arch in plantar flexions. The rigidifier may be full length or partial length. In certain embodiments, the rigidifier is disposed over at least the midfoot section 15 of the shoe and optionally over some or all of the forefoot section 11/14 and/or the rearfoot section 13. An example of a rigidified shoe 200 is shown in FIGS. 8A-8C (with the same reference numbers used to indicate parts that correspond to those of shoe 1 in FIGS. 1-2). Where needed, some degree of desired stiffness may be provided by a rigidifier 40. The rigidifier may be a relatively rigid insole or structural element, such as a shank or plate, inside or outside compartment 3 of the shoe. The rigidifier may be made of firm plastics, metals, composites, wood, board, and other such rigid materials known in the art. In FIGS. 8A-8C, rigidifier 40 is an elongate, shank that is relatively narrow and spaced in from the edges of the shoe. It is disposed longitudinally along the centerline of the shoe. The distal end 41 of the shank is blunted and is generally parallel to the proximal edge for forefoot outsole portion 25. The shank extends from the distal end of midfoot region 15 into rearfoot region 19. The shank tapers downwardly from its distal end to rearfoot portion and then, near the transition from midfoot sole region 18 and rearfoot sole region 19, reverses to an upward taper as it extends into the rearfoot region, finishing with a rounded proximal end 43. The variations in width may correspond to variations in flexibility or support. Wider areas offer more support and narrower areas more flexibility.

The rigidifier may be fixed to the shoe or it may be removably disposed on the shoe. A removable rigidifier can offer the wearer a shoe that can be customized with a range of stiffnesses. The shoe may be sold as a kit that includes a plurality of rigidifiers of varying stiffnesses or other functional properties. One advantage of such a system is that rigidifiers can be used to provide resistance to the foot to help the wearer develop proficiency at reaching or maintaining en pointe positions. The shoe can be progressively stiffened using rigidifiers of increasing stiffness. The shoe of FIG. 8B shows an example where shank 40 is removably disposed on the shoe. In this example, outsole extends over the midfoot region to rearfoot region. The outsole material is attached to another layer of material, e.g., upper compartment 3 to leave a pocket for removably receiving the rigidifier. For instance, the outsole layer is stitched or otherwise attached along its periphery to the other layer, except that the distal and/or proximal ends of the outsole are left free to form an opening to the space between the outsole and the other layer. That space receives the shank, as seen in FIG. 8C. In other embodiments the rigidifier can be disposed between other layers of material, e.g., between an insole and upper compartment 3.

Figure 4:
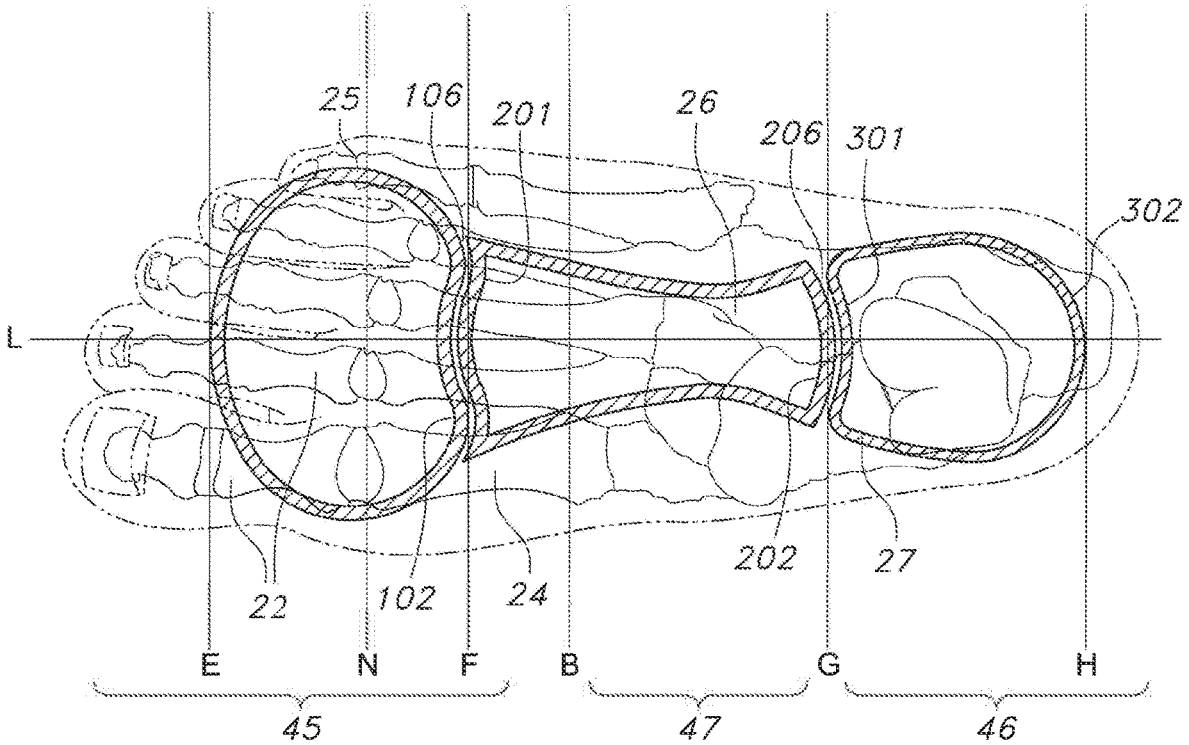
FIG. 4 shows the sole of the foot covering of FIG. 3 superimposed over the skeletal structure of a foot representative of an intended user.
Figure 5:
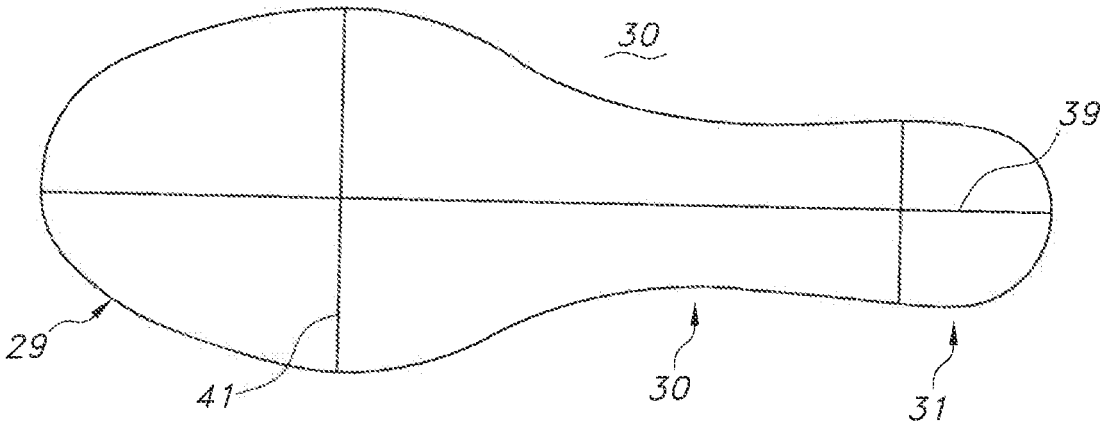
FIG. 5 schematically shows a last that may be used for constructing a foot covering according to FIG. 3.
Figure 6:
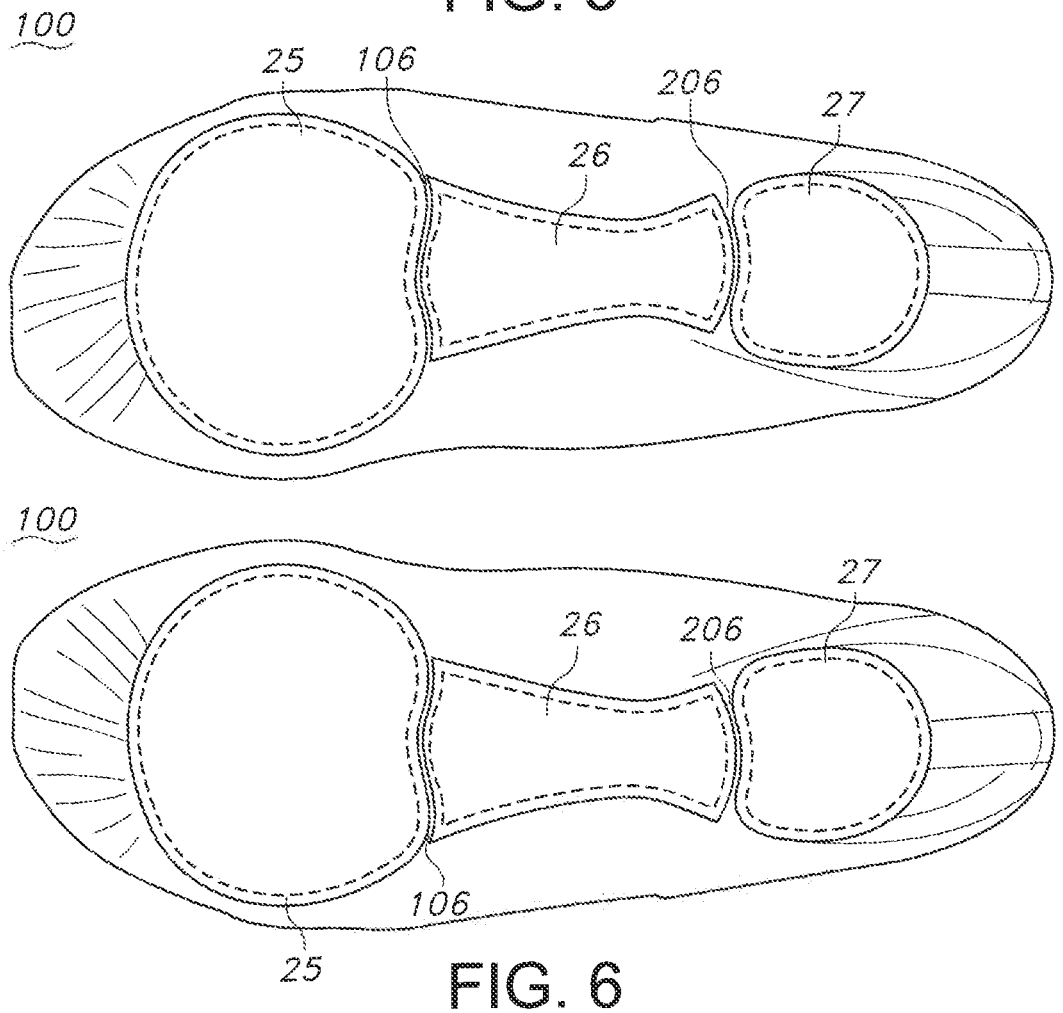
FIG. 6 shows a bottom view of left and right foot coverings according FIG. 3.
Figure 7:
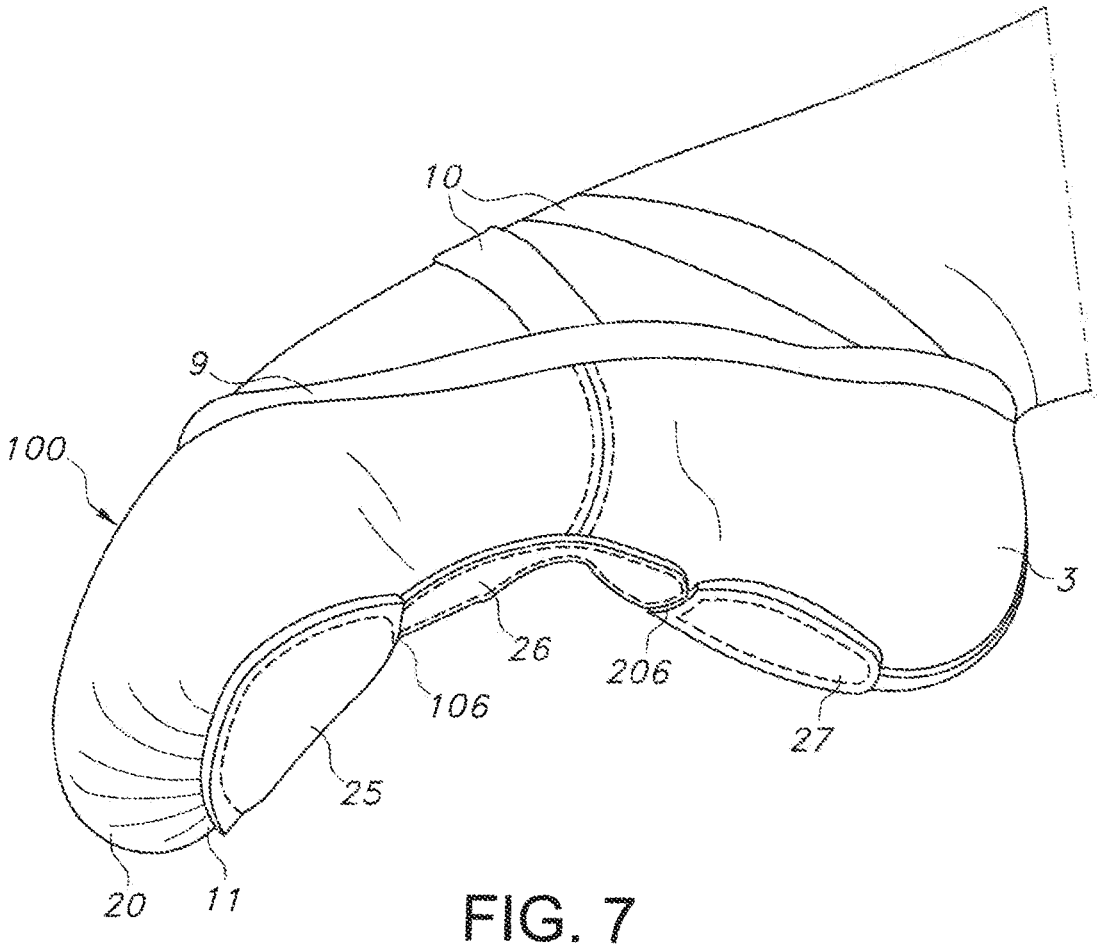
FIG. 7 shows a foot covering according to FIG. 3 on a plantar-flexed foot of an intended user.

Looking now to FIG. 4, for example, in the shoe's forefoot-midfoot sections 11/14-15, a divider may be a space or gap 106 between the outsole edges 102, 201. In the embodiment shown, gap 106 defines a flexural line that generally follows line F in FIG. 4. The gap is at about the base of the ball of the foot, below the phalangeal-metatarsal joints, which is covered by forefoot outsole portion 25. The gap allows the foot to flex natural and the shoe to conform closely to the foot, leaving a natural foot aesthetic through a range of foot positions. FIG. 7 shows a foot in plantar flexion. It can be seen that foot covering neatly conforms to the user's foot, flexing at gap 106. Foot coverings according to the inventive subject matter maintain such conformance, through a range of motion from plantar flexion through dorsiflexion.

Instead of a gap between outsole sections 25/26 or 26/27, a divider may be a thin, pliable material used in the same area, which interconnects the forefoot and midfoot sections (or midfoot and rearfoot sections). For example, a continuous length sole could be thinned in the area of the gap to define a flexural line. Or it could be a different material that is more pliable than the adjacent forefoot and midfoot (or midfoot and rearfoot) sole materials. Typically, but not exclusively, gap 106 or 206 would be from 0.5 mm to 4 mm wide, or thereabout such end points in the range.

As shown in the embodiment of FIGS. 3-7, the foot covering 100 has a midfoot outsole portion 26 with a proximal edge 202 that ends just before distal end 301 of heel outsole portion 27. Alternatively, it may extend all the way into or through rearfoot portion 13 of the shoe 3, in which case it may be considered an integral rearfoot/heel outsole portion.

In another possibility, an outsole portion is a combined forefoot/midfoot outsole portion that is disposed over forefoot and midfoot sections 11, 14 and 15. In this case, the sole is not divided in the general area of line F of FIG. 4. Instead, a proximal edge of the forefoot/midfoot outsole portion has an edge that corresponds to edge 202 and is separated from the distal edge 301 of heel outsole portion 27 in the area of line G, like in other embodiments.

The shape of the distal portion of the forefoot sole 25 may vary. In certain embodiments, the forefoot sole has a proximal edge that is disposed mainly below the metatarsal heads so as to correspond to the ball of the foot in section 14.

In the embodiment shown, edge 102 generally follows Line F, which is the proximal end of the ball of the foot. The edge 102 has concave intermediate portion 108. The concavity shallows out at the edge's lateral portions to become convexly curving at portions 110, 112. The distal edge 201 of the midfoot sole portion has a convex intermediate portion 114 that is closely spaced to, and in alignment with, the proximal edge 102 of the forefoot sole portion. The convexity 114 shallows out at the edge's lateral portions to become concavely curving at portions 116, 118. The intermediate portions 108/114 of each edge complement each other. Likewise, the lateral portions 110/116 and 112/118 of each edge complement each other.

Optionally, the foot covering may also have a rearfoot or heel outsole portion 27 that sits over the ground-facing surface of compartment 3 and is positioned at the heel section 13 of the ground-facing surface 7 of compartment 3. The heel outsole portion has a distal edge 301 and a proximal edge 302. It has left (lateral) edge 303 and right (medial) edge 304.

In the embodiment shown, proximal midfoot portion edge 202 and distal edge 301 of the rearfoot sole portion generally follow Line G of FIG. 4. The midfoot and rearfoot outsole portions 26, 27 are separated by a gap or other divider 206. In the embodiment shown, the proximal edge 202 has convex intermediate portion 208. The convexity terminates at the edge's lateral portions to become convexly curving corners at portions 210, 212. The distal edge 301 of the rearfoot sole has a concave intermediate portion 214 that is closely spaced to, and in alignment with, the proximal edge 202 of the midfoot sole portion. The concavity 214 shallows out at the edge's lateral portions to become concavely curving corners at portions 216, 218. The intermediate portions 208/214 of each edge complement or otherwise align with each other. The lateral portions 210/216 and 212/218 of each edge may complement or otherwise align with each other.

FIG. 4 illustrates the skeletal structure of a typical right foot and the perimeter profile of outsole portions 25, 26 and 27, according to an example embodiment of the inventive subject matter. The length of forefoot outsole portion 25 runs along a longitudinal line L of the foot. In particular, the length of outsole 25 is substantially situated in the area around the metatarsal-phalangeal joints, along a metatarsal line N and between two parallel lines E and F, which run perpendicular to the longitudinal line L. Line E is located at the distal end of the foot, approximately at the joining of the first and second rows of the phalanges 22; while line F is located towards the proximal end of the foot. The distal end of outsole portion 25 touches line E, approximately at the intersection of line E and longitudinal line L.

The proximal edge 102 of forefoot outsole portion 25 is generally disposed along line F in the forefoot section 45 of the foot. Thus, the forefoot outsole portion 25 covers almost all of the metatarsal heads and the second proximal row of phalanges 22. As illustrated in FIG. 4, outsole 25 is wider than it is long, and the width of the forefoot outsole portion 25 covers at least four of the five metatarsal bones 24. Outsole 25, in this embodiment, has a shape similar to a kidney or a bean. The kidney-like shape of the forefoot outsole portion 25 shown may be symmetrical. This means that when the outsole portion is folded along a longitudinal line L, the left and right portions of the outsole are identical. However, variations in shape are possible.

Similarly, the location of the midfoot outsole portion 26 at the midfoot section 13 of compartment 3 is determined by lines F and G, running perpendicular to the longitudinal line L of the foot. As shown on FIG. 4, line F is located at the distal end of the midfoot section 47 of the foot towards the distal end of the foot, while line G is located at the proximal end of the midfoot section 47 towards the proximal end of the foot. The distal edge 201 of the midfoot outsole portion 26 is generally disposed along line F. The proximal edge 202 of the midfoot outsole portion 26 is generally disposed along line G. Overall, the midfoot outsole portion 26 in the embodiment shown has a generally hour-glass shape. However, the shape may be varied as desired.

Similarly, the location of the heel outsole portion 27 at the heel section 13 of compartment 3 is generally determined by lines G and H, running perpendicular to the longitudinal line L of the foot. As shown on FIG. 4, line G is located at the heel section 46 of the foot towards the distal end of the foot, while line H is located at the heel section towards the proximal end of the foot. The distal edge 301 of heel outsole portion 27 touches is generally disposed along line G. The proximal end of the outsole portion 27 is generally disposed along line H. Overall, the heel outsole portion 27 in this embodiment may have a generally kidney-like shape that underlies the talus area 26 of the foot. However, the shape may vary as desired.

The width for the dividers 106, 206, which define transverse flexural lines, may vary depending upon the size and shape of the foot. In some suitable embodiments, the lines separations or gaps between sole portions is from 0.5 mm to 4 mm or thereabout. The gap may be defined by the edge profiles disclosed above or any other profile that generally defines a transverse flexural line generally along line F and/or G in FIG. 4. As indicated, the lines need not follow a linear path but may include straight or curving sections.

In one possible embodiment, the dimensions width/length (S/R) of the forefoot outsole portion 25, as shown in the foot covering of FIG. 4, are about 73 mm width (S)×58 mm length (R) for a size 4C dance shoe, measured along a metatarsal line S and a longitudinal line R (See FIG. 3), respectively. This results in a wider and more rounded forefoot outsole portion.

Also shown in FIGS. 1, 3 and 6-7, are ground-facing surfaces provided with flat pleats 20 in the toe section 11 of the compartment 3. These flat pleats 20 help ensure that there are no lumps of material under the foot.

The dance shoe 1 may have a topline 9 that defines a foot opening in the compartment 3. When placing the foot into dance shoe 1, 100 the topline 9 may be stretchable to enlarge the size of the foot opening. Elastic straps 10 may be incorporated with the topline 9 or other portion of compartment 3 to secure the dance shoe to the user's foot. A drawstring (not shown), attached to an edge of the fabric, may also be used to adjust the size of the foot opening. The drawstring may be any material, such as an elastic or non-elastic cord.

The inventive subject matter also contemplates a method for manufacturing of footwear in accordance with the disclosure, including assembling parts in order to achieve the articles disclosed. A method of manufacturing such a foot covering may include a step of forming a compartment for receiving a foot by using a last, having dimensions as described below, for example. The compartment is formed on the last by providing a top surface for securing the foot, and a ground-facing surface. According to one embodiment of the inventive subject matter, the foot coverings are symmetrical and interchangeable for use on left or right foot. The ground-facing surface is provided with a midfoot outsole portion that is divided from a midfoot and/or rearfoot outsole portion along flexural lines that run generally transverse to the longitudinal axis of the foot covering. The forefoot portion may have a shape corresponding approximately to the width of a foot covering at least four of the five metatarsals and a length covering approximately the metatarsal heads and the second proximal row of phalanges.

The foot compartment 3 is typically made using one or more plies of a lightweight fabric, and is free of boards or other stiffening materials, such as foam midsoles or shanks. The protective outsole portions may be made of a thin, flexible material that is more rugged than the fabric for the foot compartment and would typically be formed of a durable material for ground contact, such as natural or synthetic leather, and nonwoven textiles, and such materials may include patterns, finishes or textures such as suede. For certain styles of dance a thin flexible outsole is desired, which may be provided by a single ply of such materials. In general, the protective outsoles are sufficiently spaced from one another so that the material between the outsoles can flex and stretch to accommodate changes to the foot as the foot moves through various positions.

In certain embodiments according to the inventive subject matter, a last 30 is about the same length as but is significantly wider than conventional lasts in the the area of the metatarsal heads. This last 30 also has a toe section 29, a heel section 31, and a mid-section 30. The last 30 provides for a wider base of the dance shoe. Although the length along the longitudinal line 39 is substantially the same as the last of the prior art, the width along the metatarsal line 41 is wider than the width of the prior art last. For example, a last 30 for a shoe size 4C has a length of about 215 mm and a width of about 77 mm, measured along the longitudinal line 39 and metatarsal line 41 respectively, and thus giving a length to width ratio of 215/77 or approximately 3/1. The wider area on the last 30 allows for easy attachment of the outsole portion to the compartment. The measurement for the instep circumference, which is the widest point on the forefoot of the last, is about 21 cm on both lasts.

The dimensions and ratios given herein are representative. A person skilled in the art will be able to ascertain variances without undue effort that achieves the advantages disclosed herein. From the foregoing embodiments, it should be appreciated that a dance shoe compartment can be constructed by stitching materials and elements together to result in flat and generally straight or regular lines that enhance fit and comfort. While the inventive subject matter disclosed herein is directed to a foot covering of substantially single ply material, other materials or plies may be added or otherwise used, e.g. to impart desired properties.

The outsoles may be attached to the compartment in a number of different ways as is known in the art, including adhesion and stitching.

In addition to the features discussed above, other embodiments may have split or partial uppers with, for example, elastic straps attached at the back of the dance shoe, allowing the dancer to adjust the position of the shoe.

It is understood that other embodiments may be provided, such as for example, varying one or more of the features set out in the example embodiments. To illustrate, such variations may be directed to one or more dimensions and/or positions of the soles or other body contours, shapes and dimensions.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by references in its entirety for all purposes.

The principles described above in connection with any particular technology example can be combined with the principles described in connection with each other technology example described herein, as will be appreciated by one of ordinary skill in the art following a review of this disclosure. Accordingly, this detailed description shall not be construed in a limiting sense, and following a review of this disclosure, those of ordinary skill in the art will appreciate the wide variety of energy harvesting and/or power-delivery platforms, and related systems incorporating disclosed accessories with such platforms, that can be devised using the various concepts described herein. Moreover, those of ordinary skill in the art will appreciate that the exemplary embodiments disclosed herein can be adapted to various other configurations and/or uses without departing from the disclosed principles.

Thus, the foregoing description of disclosed embodiments is provided to enable any person of ordinary skill in the art to make or use the disclosed innovations. Accordingly, no innovations presently claimed, or claimed in the future, are intended to be limited to the embodiments expressly shown or described herein, but are to be accorded their full scope consistent with the language of the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim recitation is to be construed under the provisions of 35 U.S.C. 112(f), unless the recitation is expressed using the phrase "means for" or "step for".

Thus, in view of the many possible embodiments to which the disclosed principles can be applied, we reserve to the right to claim any and all combinations of features described herein and all that comes within the scope and spirit of the foregoing description.

The invention claimed is:

1. A foot covering, comprising:

a thin, flexible compartment for receiving a foot, the compartment having a forefoot section, a mid-section, and a heel section;

the compartment having a top surface for securing the foot and a ground-facing surface having a sole divided into at least two portions comprising at least a midfoot portion and a paired forefoot portion divided therefrom;

wherein the forefoot sole portion has a coverage area extending from a proximal edge configured to extend just proximally to at least four of the five metatarsal heads, at least one metatarsal head being the first metatarsal to a distal edge configured to extend at about the second proximal row of phalanges, and from a lateral edge to a medial edge;

wherein each pair of sole portions is divided along a flexural line running generally transverse to the longitudinal axis of the foot covering, and wherein the sole portions and flexural line, in combination with the flexible compartment, have a material construction and are arranged so as to facilitate a close conforming of the foot covering to the foot of an intended user through plantar flexion to dorsiflexion foot movements.

2. The foot covering of claim 1 wherein the sole is divided between (1) forefoot and midfoot portions and (2) between midfoot and rearfoot portions.

3. The foot covering of claim 1 wherein the forefoot sole portion has a shape that is wider than it is long; corresponding approximately to the width of a foot and covering approximately the first to the fifth metatarsal heads.

4. The foot covering of claim 1, wherein the ground-facing surface is mainly free of stiffening material at the forefoot and/or mid-section of the covering.

5. The foot covering of claim 1, wherein the forefoot sole portion has a substantially kidney-like shape.

6. The foot covering of claim 2, wherein the rearfoot sole portion has a substantially kidney-like shape.

7. The foot covering of claim 1, wherein the compartment comprises a ground-facing surface provided with flat pleats around at least the forefoot section.

8. The foot covering of claim 1, wherein the compartment is formed of a substantially single ply material.

9. The foot covering of claim 8, wherein the compartment is elastic.

10. The foot covering of claim 1, wherein the compartment further comprises a binding and/or an over-the-arch strap system to hold the covering on a foot.

11. The foot covering of claim 1, wherein the ground-facing surface has a length to width ratio of about 3/1.

12. The foot covering of claim 1 further comprising a rigidifier that is disposed over at least over a midfoot section of the covering, the rigidifier configured in the covering so as to cause resistance against the arch of the foot and help the covering mirror the arch of the foot for better fit against the arch in plantar flexions.

13. The foot covering of claim 12 wherein the rigidifier has varying width along its length and thereby a corresponding varying rigidity along its length.

14. The foot covering of claim 12 wherein the rigidifier is removably disposed in a pocket formed in the covering.

15. The foot covering of claim 14 further comprising a one or more additional rigidifiers configured for the pocket, each rigidifier varying in rigidity from another rigidifier.

16. The foot covering of claim 14 wherein the pocket is disposed between the midfoot sole portion and the foot compartment.

17. The foot covering of claim 1, wherein the midfoot sole portion extends from a distal edge closely adjacent to the proximal edge of the forefoot section and spaced therefrom by the flexural edge, and over at least a portion of an arch of the foot.

* * * * *